United States Patent [19]

Hunt

[11] Patent Number: 4,805,610

[45] Date of Patent: Feb. 21, 1989

[54] SWIMMER'S SNORKEL

[76] Inventor: Howard W. Hunt, 4116 Accomack Dr., Louisville, Ky. 40241

[21] Appl. No.: 29,138

[22] Filed: Mar. 23, 1987

[51] Int. Cl.[4] ..... B63C 11/16

[52] U.S. Cl. ..... 128/201.11; 128/201.27

[58] Field of Search ..... 128/200.29, 201.11, 128/201.27

[56] References Cited

U.S. PATENT DOCUMENTS

| | | | |
|---|---|---|---|
| 1,324,514 | 12/1919 | Müller | 128/201.11 |
| 2,488,261 | 11/1949 | Bedini | 128/201.11 |
| 2,814,292 | 11/1957 | Girdin | 128/201.11 |
| 3,141,469 | 7/1964 | Stradella | 128/201.11 |
| 3,467,091 | 9/1969 | Aragona | 128/201.11 |
| 3,768,504 | 10/1973 | Rentsch, Jr. | 128/201.11 |

FOREIGN PATENT DOCUMENTS

| | | | |
|---|---|---|---|
| 443802 | 7/1912 | France | 128/201.11 |
| 2581959 | 11/1986 | France | 128/201.11 |
| 457663 | 12/1936 | United Kingdom | 128/201.11 |
| 775104 | 5/1957 | United Kingdom | 128/201.11 |

*Primary Examiner*—Edward M. Coven
*Assistant Examiner*—John P. Lacyk

[57] ABSTRACT

A snorkel for use by divers has the end of the tube which is uppermost when the snorkel is attached to the diver's head equipped with a valve one element of which is attached to a cap and the other valve element is incorporated in that end. The cap is buoyant when the upper end is in danger of being flooded, the valve elements then coacting to close the upper end and when the upper end is above the water level, the weight of the cap is such as to effect disengagement of the valve elements. The lower end of the tube has a valve opened when the diver exhales and a check valve above the connection of the mouthpiece with the tube is then closed. In the preferred embodiment, the cap is a loose fit on the upper end and is thus free to rock under the impact of waves then momentarily to close the valve.

5 Claims, 2 Drawing Sheets

SWIMMER'S SNORKEL

BACKGROUND OF THE INVENTION

Many swimmers who enjoy diving and underwater swimming use snorkels as they make surfacing unnecessary in order to breath as a snorkel is so dimensioned that its upper end can extend above water while the user is partly or wholly submerged.

One difficulty attendant the use of conventional snorkels is that after the swimmer dives, his snorkel becomes filled with water which must be expelled, after surfacing, before he may again fill his lungs with fresh air. In one type of snorkel, the difficulty is lessened by means of a normally closed valve below the mouthpiece which valve opens when the wearer exhales thus to block the entrance of water into the snorkel as long as its upper end is above water.

Another difficulty which snorkel users experience is that the upper end of the snorkel, when fresh air is to be inhaled, may be flooded by a wave. If that happens, the snorkel will be at least partially filled with water with the likelihood that some water will be inhaled so that, at best, the user will again have to exhaust the water from the snorkel before again trying to fill his lungs with fresh air.

THE PRESENT INVENTION

The general objective of the present invention is to provide snorkels that are safer and more convenient to use.

In accordance with one aspect of the invention, this objective is attained by providing the upper end of the snorkel with a valve consisting of first and second elements which coact to close the upper end of the snorkel. One of the elements is incorporated in the upper end of the snorkel and the other element is a part of a buoyant valve operator so connected to the snorkel that when its upper end is in danger of being flooded the valve elements coact and prevent water from entering. The weight of the operator, once the upper end of the snorkel is a safe distance above water, effects the disengagement of the valve elements.

In addition to the above float operated valve, a snorkel in accordance with the invention has a normally closed air exhaust valve below the mouthpiece which opens when the user exhales and, desirably, a check valve is located in the snorkel above and close to the mouthpiece with the check valv open when air is inhaled and closed when air is exhaled.

A snorkel provided with a float controlled valve at its air intake end, an exhaust valve at its other end opened when the user exhales and a check valve above the mouthpiece which is then closed is effective in use. Such a snorkel may have its air intake end sufficiently above the water level at which the valve operator becomes buoyant to avoid flooding by normal waves or it may and preferably does have its valve seat close to that water level. In the former case, the length of the snorkel above the user's head would be excessive while in the latter case the snorkel is of use only where and when the water is relatively calm. In this connection, note the float controlled fresh iar intake valve of the life preserver of U.S. Pat. No. 1,324,514.

In accordance with another aspect of the invention, the buoyant operator of the float actuated valve is capable of being moved relative to the upper end of the snorkel by waves in response to which movements so that the valve is momentarily closed thus to enable the snorkel to be used under any and all conditions.

Other objectives of the invention and the manner of their attainment will be apparent from the following description of the preferred embodiment and the appended claims.

BRIEF DESCRIPTION OF THE DRAWINGS

The accompanying drawings illustrate a preferred embodiment of a snorkel in accordance with the invention

THE PREFERRED EMBODIMENT OF THE INVENTION

Figure 1:
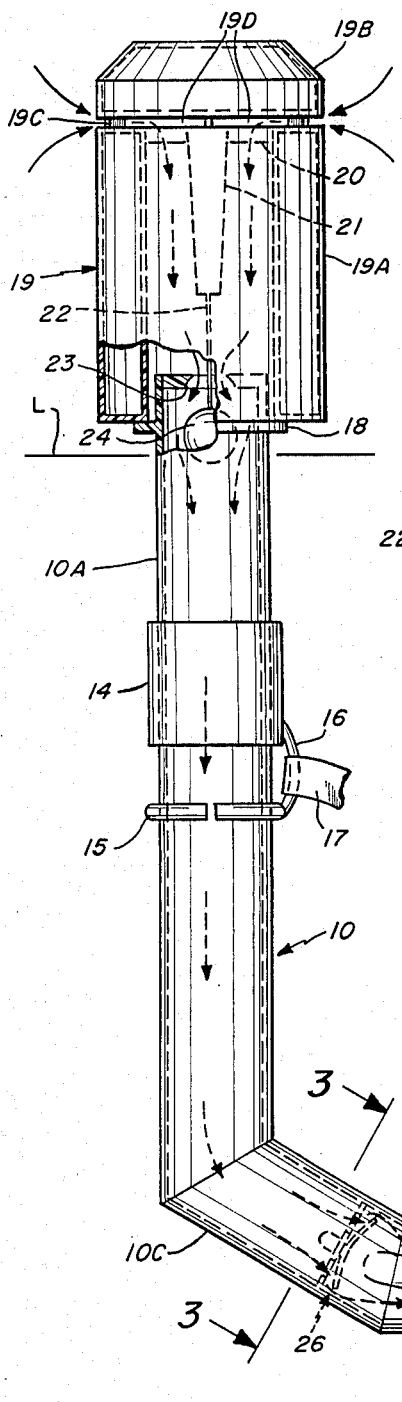
FIG. 1 is a partly sectioned side view of the snorkel with the float operated valve open.

The snorkel illustrated by the drawings and generally indicated at 10 is tubular and is shown as consisting of a relatively long first section 10A joined to a relatively short section 10B by an intermediate third section positioning the sections 10A and 10B substantially at a right angle relative to each other.

The section 10B has a boss 11 in support of a mouthpiece 12 and provided with a port 13 placing the interior of the snorkel in communication with the mouth of the user. In practice, a snorkel is detachably attached to the face mask of the user and such attachment may be variously effected. By way of example, the section 10A is shown as having a clip 14 connected to a split ring 15 by a band 16 enabling a strap 17 of the face mask, not shown, to be caught thereby with the section 10A then extending upwardly above the head of the user when the face mask is in place. The clip 14 and the ring 15 are desirably friction fits on the section 10A so that their positions can be adjusted as required by the user.

The section 10A has an external flange or seat 18 adjacent its upper end on which the valve operator, generally indicated at 19 can rest. The valve operator is in the form of a buoyant sleeve 19A having a cap 19B connected thereto by spacers 19C in a manner providing circumferential ports 19D. The sleve 19A has a diametrically disposed bridge 20 provided with a central, depending support 21 for a rod 22 which extends downwardly through an annular, concave seat 23 close to the upper end of the section 10A. A ball 24 below the seat 23 is fixed on the rod 22 and when the valve operator 19 rests on the seat 18 as it does when it is no longer floating and the upper end of the section 10A is above water, the ball is free of the seat 23 and the section 10A is open, see FIG. 2. When, however, the water level L is within a predetermined distance from the upper end of the section 10A, the valve operator becomes buoyant and lifts the ball2 4 into sealing engagement with the seat 23 preventing flow of water into the snorkel through the section 10A.

Figure 5:
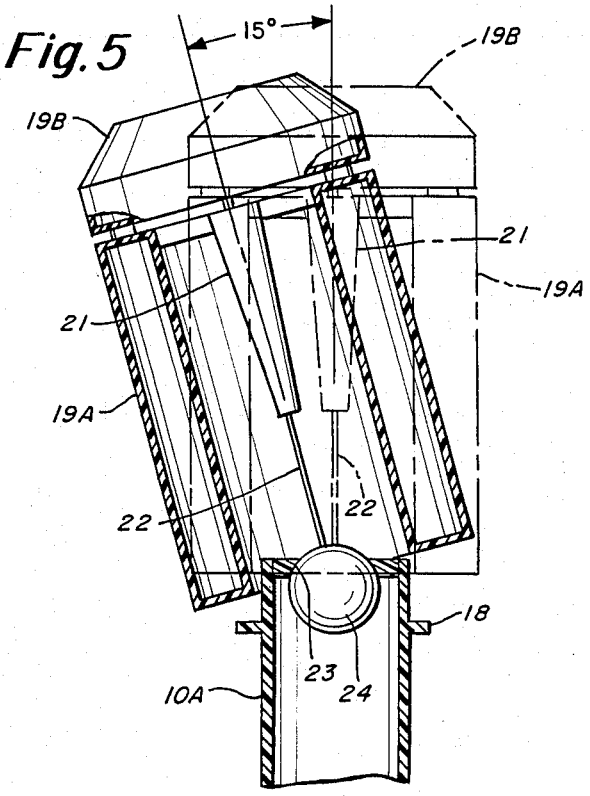
FIG. 5 is a partly sectioned side view of the float operated valve illustrating the closing thereof as the valve operator is rocked by waves.

It will be noted, see FIG. 5, that the sleeve 19A is such a free fit on the upper end of the section 10A that when the sleeve 19A is in its elevated position, it will rock, within limits, under the impact of waves against its side and hold the ball 24 seated to cause momentary closing of the upper end of the section 10A. It will also be noted that this feature ensures that the float controlled valve will remain closed when the user is swimming under water.

The free end of the section 10B is provided with an exhaust valve 25 of a type which is normally closed but which opens when the user exhales. The valve 25, by itself, would not effectively purge the snorkel of exhaust air and in accordance with the invention, a valve 26 is incorporated in the snorkel as close to the mouthpiece, but between it and section 10A, as is practicable, in the disclosed embodiment in the snorkel section 10C. The valve 26 is of a type which is normally open but which closes when the user exhales. It will be appreciated that due to the small volumetric capacity of the space between the valves 25 and 26, there is little air remaining to contaminate inhaled air after exhaling.

Figure 2:
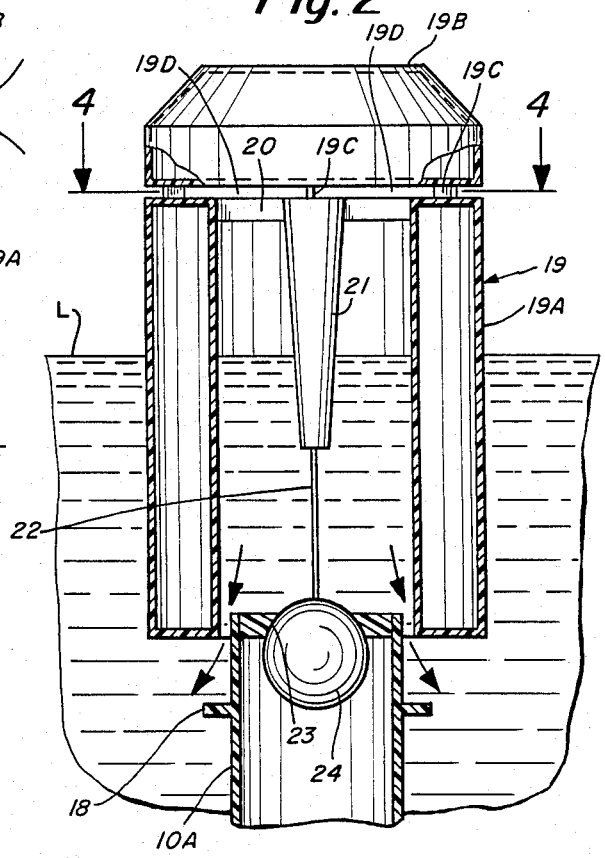
FIG. 2 is a fragmentary and partly sectioned view, on a substantial increase in scale, of the float operated valve closed.
Figure 3:
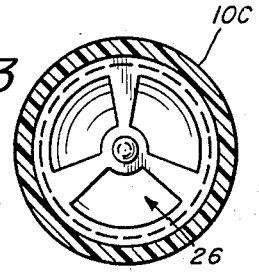
FIG. 3 is a section, on an increase in scale taken along the indicated line 3—3 of FIG. 1.
Figure 4:
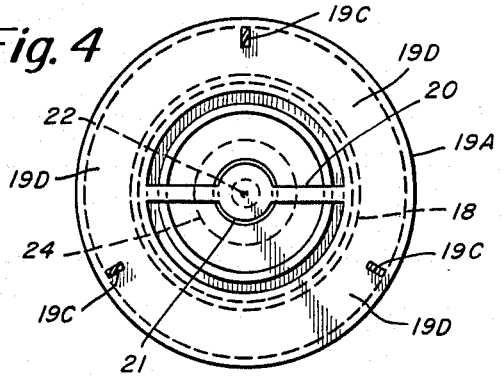
FIG. 4 is a section taken approximately along the indicated line 4—4 of FIG. 2.

The use and advantages of snorkels in accordance with the invention will be apparent from the foregoing except for the feature that, as illustrated by FIG. 2, the space within the valve operator is self-draining due to the free fit of the sleeve 19A on the upper end of the section 10A.

I claim:

1. A snorkel for use by a skin diver, said snorkel including a tube having first and second ends, the first end being the air intake end and the second end being the air exhaust end, a mouthpiece opening into the tube adjacent the second end, means operable to secure the snorkel to the head of a diver with the first end then extending above the diver's head, valve means incorporated in the second end for opening during diver exhalation, and second valve means, means connecting the second valve means to the first end of the tube, said second valve means including a buoyant operating sleeve and first and second valve elements of which one is a ball and the other a seat, said sleeve surrounding and extending beyond said first end and shaped and dimensioned relative thereto so as to enable the sleeve both to rock and to move vertically relative to said first end, said first and second valve elements within said sleeve, the first valve element fixed on said first end of the tube, said second valve element connected to the interior of the sleeve in a manner bringing the second valve element into sealing engagement with the first element on vertical movement of the sleeve when the water level is close to but below said first end and when the sleeve is rocked by a wave, said engaged elements then holding said sleeve connected to said first end.

2. The snorkel of claim 1 in which the first and second valve elements constitute the means connecting the second valve means to the first end of the tube.

3. The snorkel of claim 1 in which the first element is a downwardly disposed, concave seat in the first end of the tube, the second element is a ball below the seat and a ball centering connection secured to the sleeve extends through the seat and is connected to the ball and the sleeve is free to rock in response to the action of waves and bring the ball into engagement with the seat.

4. The snorkel of claim 3 in which the tube includes an external seat adjacent the first end on which the sleeve rests when the first end of the tube is a predetermined distance above water and the ball centering connection is dimensioned to limit the extent to which the sleeve can move vertically relative to the first end of the tube.

5. The snorkel of claim 3 in which the sleeve has upper and lower ends and a cap closing the upper end of the sleeve against overhead water and a connection between the cap and the sleeve establishing laterally opening ports.

* * * * *